US010907924B2

(12) United States Patent
Bei et al.

(10) Patent No.: US 10,907,924 B2
(45) Date of Patent: Feb. 2, 2021

(54) POSITION ADJUSTING DEVICE, SHOOTING GAME DEVICE USING THE SAME AND SHOOTING METHOD THEREOF

(71) Applicant: SZ DJI TECHNOLOGY CO., LTD., Shenzhen (CN)

(72) Inventors: Shimeng Bei, Shenzhen (CN); Yijun Guan, Shenzhen (CN); Yiqi Chen, Shenzhen (CN)

(73) Assignee: SZ DJI TECHNOLOGY CO., LTD., Shenzhen (CN)

( * ) Notice: Subject to any disclaimer, the term of this patent is extended or adjusted under 35 U.S.C. 154(b) by 0 days.

(21) Appl. No.: 16/524,797

(22) Filed: Jul. 29, 2019

(65) Prior Publication Data

US 2020/0109910 A1 Apr. 9, 2020

Related U.S. Application Data

(63) Continuation of application No. 16/115,102, filed on Aug. 28, 2018, now Pat. No. 10,378,851, which is a continuation of application No. 15/442,934, filed on Feb. 27, 2017, now Pat. No. 10,066,893, which is a continuation of application No. PCT/CN2014/085613, filed on Aug. 29, 2014.

(51) Int. Cl.

| | |
|---|---|
| ***F41B 4/00*** | (2006.01) |
| ***A63B 69/40*** | (2006.01) |
| ***F41B 7/08*** | (2006.01) |
| ***F41A 23/24*** | (2006.01) |
| ***F41A 27/14*** | (2006.01) |
| ***F41B 11/89*** | (2013.01) |

(52) U.S. Cl.

CPC ..... *F41B 4/00* (2013.01); *A63B 69/406* (2013.01); *F41A 23/24* (2013.01); *F41A 27/14* (2013.01); *F41B 7/08* (2013.01); *F41B 11/89* (2013.01)

(58) Field of Classification Search

CPC ..... A63B 69/40; A63B 69/406; F41B 4/00; F41B 11/50; F41B 11/53

See application file for complete search history.

(56) References Cited

U.S. PATENT DOCUMENTS

| | | | |
|---|---|---|---|
| 3,538,900 | A | 11/1970 | Samuels |
| 3,777,732 | A | 12/1973 | Holloway et al. |
| 4,299,383 | A | 11/1981 | Yuasa et al. |
| 4,325,351 | A | 4/1982 | Yuasa et al. |
| 4,442,823 | A | 4/1984 | Floyd et al. |
| 4,864,060 | A | 9/1989 | Karalis et al. |

(Continued)

FOREIGN PATENT DOCUMENTS

| | | | |
|---|---|---|---|
| CN | 2161432 | Y | 4/1994 |
| CN | 1468127 | A | 1/2004 |

(Continued)

OTHER PUBLICATIONS

The World Intellectual Property Organization (WIPO) International Search Report for PCT/CN2014/085613 dated Feb. 27, 2015 6 Pages.

*Primary Examiner* — John A Ricci

(74) *Attorney, Agent, or Firm* — Anova Law Group, PLLC

(57) ABSTRACT

A position adjusting device includes a first support member, a mounting seat disposed on the first support member and including a receiving seat and a pivot shaft disposed in the receiving seat, and a second support member carried by the receiving seat.

20 Claims, 9 Drawing Sheets

(56) References Cited

U.S. PATENT DOCUMENTS

| | | | | |
|---|---|---|---|---|
| 5,125,653 | A | 6/1992 | Kovacs et al. | |
| 6,880,542 | B1 | 4/2005 | Johndreau et al. | |
| 7,082,938 | B2 | 8/2006 | Wilmot | |
| 8,287,404 | B2 | 10/2012 | Cucjen et al. | |
| 8,720,427 | B2 | 5/2014 | Chen | |
| 10,066,893 | B2 * | 9/2018 | Bei | A63B 69/406 |
| 2001/0010221 | A1 | 8/2001 | Nishio et al. | |
| 2003/0105603 | A1 | 6/2003 | Hardesty | |

FOREIGN PATENT DOCUMENTS

| | | | |
|---|---|---|---|
| CN | 1499167 | A | 5/2004 |
| CN | 101462007 | A | 6/2009 |
| CN | 102055378 | A | 5/2011 |
| CN | 201837309 | U | 5/2011 |
| CN | 202195748 | U | 4/2012 |
| CN | 102743109 | A | 10/2012 |
| CN | 202802782 | U | 3/2013 |
| CN | 103129725 | A | 6/2013 |
| CN | 203540028 | U | 4/2014 |
| DE | 202013101105 | U1 | 4/2013 |
| JP | S5581370 | U | 6/1980 |
| JP | S55109569 | U | 7/1980 |
| JP | 2001201290 | A | 7/2001 |
| JP | 3522183 | B2 | 4/2004 |
| JP | 2013215458 | A | 10/2013 |

* cited by examiner

POSITION ADJUSTING DEVICE, SHOOTING GAME DEVICE USING THE SAME AND SHOOTING METHOD THEREOF

CROSS-REFERENCE TO RELATED APPLICATIONS

This application is a continuation of application Ser. No. 16/115,102, filed on Aug. 28, 2018, which is a continuation of application Ser. No. 15/442,934, filed on Feb. 27, 2017, now U.S. Pat. No. 10,066,893, which is a continuation application of International Application No. PCT/CN2014/085613, filed on Aug. 29, 2014, the entire contents of all of which are incorporated herein by reference.

TECHNICAL FIELD

The present disclosure relates to a position adjusting device, a shooting game device using the same, and a shooting method thereof.

BACKGROUND

Using BB bullets in shooting games provides the pleasure of firing live ammunition in a real situation that does not happen in laser shooting games. Therefore, using the BB bullets in shooting games has been popularized in the entertainment industry. However, an existing BB bullet game gun has a low-capacity bullet carriage. In a shooting game, each time a bullet is fired, a shooter is required to load the next bullet in time, and it is necessary to manually adjust the direction of the muzzle, which troubles the shooter a lot and cannot provide the pleasure of firing live ammunition.

In addition, the existing BB bullet game gun is designed to produce propulsion to fire a bullet by manually pulling a spring, electrically pulling a spring, or compressing the air. When a finger pulls the trigger and an elastic force is released, a lever strikes an object (bullet) to produce a reacting force to cause the object (bullet) to fly forward.

Thus, such game guns have a complicated structure, and are tedious to operate and less entertaining.

SUMMARY

An objective of the present disclosure is to provide a position adjusting device having a simple structure and being operably entertaining, a shooting game device using the same, and a shooting method thereof.

An embodiment of the present disclosure is implemented as a position adjusting device for rotationally adjusting the position of a firing device for firing toy bullets. The position adjusting device includes a first support member, a yaw axis motor disposed on the first support member, a second support member rotatably disposed on the first support member through the yaw axis motor, and a pitch axis motor disposed on the second support member and used for driving the firing device to rotate. The yaw axis motor is used for driving the second support member to rotate about a yaw axis to cause the firing device to rotate about the yaw axis, and the pitch axis motor is used for driving the firing device to rotate about a pitch axis.

The position adjusting device further includes a mounting seat. The yaw axis motor is connected to the mounting seat, and the second support member is rotatably mounted to the first support member through the mounting seat.

The mounting seat includes a receiving seat and a pivot shaft disposed in the receiving seat. The mounting seat is disposed between the first support member and the second support member. The receiving seat is used for carrying the second support member and the firing device, and the yaw axis motor is used for driving the pivot shaft of the mounting seat to rotate so as to drive the second support member to rotate.

The first support member includes two first brackets and a first connecting plate that connects the two first brackets The first connecting plate includes a top surface and a bottom surface away from the top surface. The bottom surface and inner walls of the two first brackets jointly form a receiving portion, and the yaw axis motor is received in the receiving portion and fixed onto the bottom surface.

The first connecting plate is provided with a first through hole penetrating the top surface and the bottom surface. The position adjusting device further includes a bearing which is fixed into the first through hole. The yaw axis motor includes a rotating shaft The rotating shaft of the yaw axis motor passes through the bearing The pivot shaft is hollow, which includes a receiving cavity for receiving the rotating shaft of the yaw axis motor and a connecting portion The second support member is provided with a receiving hole, and the connecting portion is fixed into the receiving hole.

The rotating shaft and the pivot shaft are fixedly connected with each other by welding or glue.

The rotating shaft and the receiving cavity are fixedly connected with each other by interference fit.

The second support member includes two second brackets and a second connecting plate that connects the two second brackets. The second connecting plate is disposed oppositely to the first connecting plate, and the receiving hole is opened on the second connecting plate.

The mounting seat further includes a first bearing, a fixing ring, and a second bearing. The first bearing, the fixing ring, the pivot shaft, and the second bearing are all received in the receiving seat The fixing ring and the second bearing are both sleeved on an outer sidewall of the pivot shaft, and the fixing ring is located between the first bearing and the second bearing.

The pitch axis motor is disposed on one end of one of the second brackets, and one end of the other one of the second brackets is provided with a fixed shaft.

The receiving seat is provided with a window The pivot shaft is provided with a first fixing hole. The fixing ring is provided with a plurality of second fixing holes. At least one of the plurality of second fixing holes is aligned with the first fixing hole and exposed outside the receiving seat through the window The position adjusting device further includes a fixing bolt which is inserted into the at least one of the plurality of second fixing holes and the first fixing hole through the window to cause one end of the fixing bolt to abut against the rotating shaft and to cause the rotating shaft to be fixedly connected with the pivot shaft.

The fixing bolt is a threaded bolt, and the first fixing hole and the second fixing holes are all threaded holes corresponding to the fixing bolt.

The pitch axis motor includes a rotary shaft.

An embodiment of the present disclosure is implemented as a shooting game device including a firing device for firing toy bullets and a position adjusting device for rotationally adjusting the firing device. The position adjusting device includes a first support member, a yaw axis motor disposed on the first support member, a second support member rotatably disposed on the first support member through the yaw axis motor, and a pitch axis motor disposed on the second support member and used for driving the firing device to rotate. The yaw axis motor is used for driving the second support member to rotate about a yaw axis to cause the firing device to rotate about the yaw axis, and the pitch axis motor is used for driving the firing device to rotate about a pitch axis.

The position adjusting device further includes a mounting seat. The yaw axis motor is connected to the mounting seat, and the second support member is rotatably mounted to the first support member through the mounting seat.

The mounting seat includes a receiving seat and a pivot shaft disposed in the receiving seat, the mounting seat is disposed between the first support member and the second support member. The receiving seat is used for carrying the second support member and the firing device, and the yaw axis motor is used for driving the pivot shaft of the mounting seat to rotate so as to drive the second support member to rotate.

The first support member includes two first brackets and a first connecting plate that connects the two first brackets. The first connecting plate includes a top surface and a bottom surface away from the top surface. The bottom surface and inner walls of the two first brackets jointly form a receiving portion, and the yaw axis motor is received in the receiving portion and fixed onto the bottom surface.

The first connecting plate is provided with a first through hole penetrating the top surface and the bottom surface. The position adjusting device further includes a bearing which is fixed into the first through hole. The yaw axis motor includes a rotating shaft. The rotating shaft of the yaw axis motor passes through the bearing. The pivot shaft is hollow, which includes a receiving cavity for receiving the rotating shaft of the yaw axis motor and a connecting portion. The second support member is provided with a receiving hole, and the connecting portion is fixed into the receiving hole.

The rotating shaft and the pivot shaft are fixedly connected with each other by welding or glue.

The rotating shaft and the receiving cavity are fixedly connected with each other by interference fit.

The second support member includes two second brackets and a second connecting plate that connects the two second brackets. The second connecting plate is disposed oppositely to the first connecting plate, and the receiving hole is opened on the second connecting plate.

The mounting seat further includes a first bearing, a fixing ring, and a second bearing. The first bearing, the fixing ring, the pivot shaft, and the second bearing are all received in the receiving seat The fixing ring and the second bearing are both sleeved on an outer sidewall of the pivot shaft, and the fixing ring is located between the first bearing and the second bearing.

The pitch axis motor is disposed on one end of one of the second brackets.

The receiving seat is provided with a window. The pivot shaft is provided with a first fixing hole. The fixing ring is provided with a plurality of second fixing holes. At least one of the plurality of second fixing holes is aligned with the first fixing hole and exposed outside the receiving seat through the window. The position adjusting device further includes a fixing bolt which is inserted into the at least one of the plurality of second fixing holes and the first fixing hole through the window to cause one end of the fixing bolt to abut against the rotating shaft and to cause the rotating shaft to be fixedly connected with the pivot shaft.

The fixing bolt is a threaded bolt, and the first fixing hole and the second fixing holes are all threaded holes corresponding to the fixing bolt.

The pitch axis motor includes a rotary shaft. One end of the other one of the second brackets is provided with a fixed shaft. The firing device includes a magazine for receiving a plurality of toy bullets. One side wall of the magazine is provided with a rotary pillar corresponding to the position of the fixed shaft, and another side wall of the magazine is provided with a hollow connecting pillar corresponding to the position of the rotary shaft of the pitch axis motor. The rotary pillar is sleeved in the fixed shaft, and the connecting pillar is fixedly connected with the rotary shaft through a bolt.

The firing device further includes a cover plate covering the magazine. The cover plate is fixed to the magazine, and the cover plate is provided with an inlet, through which the toy bullets are put in.

The firing device further includes a rotor disposed in the magazine. A driving device for drives the rotor to rotate. The rotor includes a plurality of blades. A toy bullet is clamped between two adjacent blades, and the driving device is fixed onto a bottom plate of the magazine and is connected with the rotor for driving the rotor to rotate.

The driving device is a low-speed high-torque motor.

The driving device is driven by a pulse signal, and each time the driving device is triggered, an angle by which the rotor is driven to rotate is equal to an angle between the two adjacent blades.

The firing device further includes a turret. The turret is connected with the magazine. The turret includes a conduit, a barrel aligned with the conduit, and a propelling device disposed between the conduit and the barrel. A bottom plate of the magazine is provided thereon with a bullet output port. The conduit is disposed below the magazine, and the conduit is provided with a guide slot, which includes a bullet inlet aligned with the bullet output port of the magazine.

The guide slot is a 90-degree guide slot, which further includes a bullet outlet. A central axis of the bullet inlet is parallel to that of the bullet output port. The central axis of the bullet inlet is perpendicular to that of the bullet outlet. The propelling device includes two friction wheels which are disposed side by side between the guide slot and the barrel, and a gap formed between the two friction wheels is aligned with the bullet outlet of the guide slot.

Each of the friction wheels includes a motor and an elastic ring that rotates under the driving of the motor. The two friction wheels rotate in opposite directions. The shortest spacing between the two elastic rings is less than the diameter of the toy bullet, and when the friction wheels rotate in opposite directions, the two elastic rings exert friction on a toy bullet to cause the toy bullet to gain kinetic energy such that the toy bullet can be fired.

The friction wheel further includes a connecting ring. The motor includes a rotor portion which includes a first connecting portion connected with the connecting ring, and the connecting ring is clamped onto the first connecting portion and rotates with rotation of the rotor portion.

The connecting ring includes a round body portion and a protrusion extending radially from the body portion.

The friction wheel further includes a protection ring. The rotor portion includes a second connecting portion, and the protection ring is connected with the second connecting portion and abuts against the elastic ring.

The turret further includes a sighting device disposed below the barrel.

The firing device further includes a guide plate disposed in the magazine. The guide plate is arc-shaped and disposed above the bullet output port, and the guide plate and the bottom plate are at a certain bevel angle.

The turret further includes a limiting device disposed between the conduit and the barrel.

The shooting game device further includes a first electronic speed control and a second electronic speed control. The first electronic speed control is disposed on the first connecting plate and is electrically connected with the yaw axis motor. The first electronic speed control is used for adjusting a rotational speed of the yaw axis motor The second electronic speed control is disposed on a second bracket of the second support member and is electrically connected with the pitch axis motor, and the second electronic speed control is used for adjusting a rotational speed of the pitch axis motor.

An embodiment of the present disclosure is implemented as a shooting game method, including the following steps of:

putting in a plurality of toy bullets;

driving, by a yaw axis motor, the firing device to rotate about a yaw axis;

driving, by a pitch axis motor, the firing device to rotate about a pitch axis; and firing the toy bullets.

Compared with the prior art, the position adjusting device according to the present disclosure can drive the firing device to rotate about a yaw axis through the yaw axis motor, and at the same time, can drive the firing device to rotate about a pitch axis through the pitch axis motor, so that the position adjusting device controls the firing device to achieve actions of rotating horizontally and pitching up and down flexibly and freely. This puts forward higher requirements for both the stability and the speed at which the actions are completed, and can also avoid manually adjusting the direction of the muzzle. The operation steps are simple and highly entertaining. In addition, owing to the absence of a reduction gearbox or another torque increasing mechanism, the problem that the mechanism is complicated is solved.

DETAILED DESCRIPTION OF THE EMBODIMENTS

To make the objectives, technical solutions and advantages of the present disclosure more comprehensible, the present disclosure is further described in detail below with reference to the accompanying drawings and implementation manners. It should be understood that the specific implementation manners described herein are merely used to explain the present disclosure, but are not used to limit the present disclosure.

Implementation of the present disclosure is described in detail below in combination with specific implementation manners.

Figure 1:
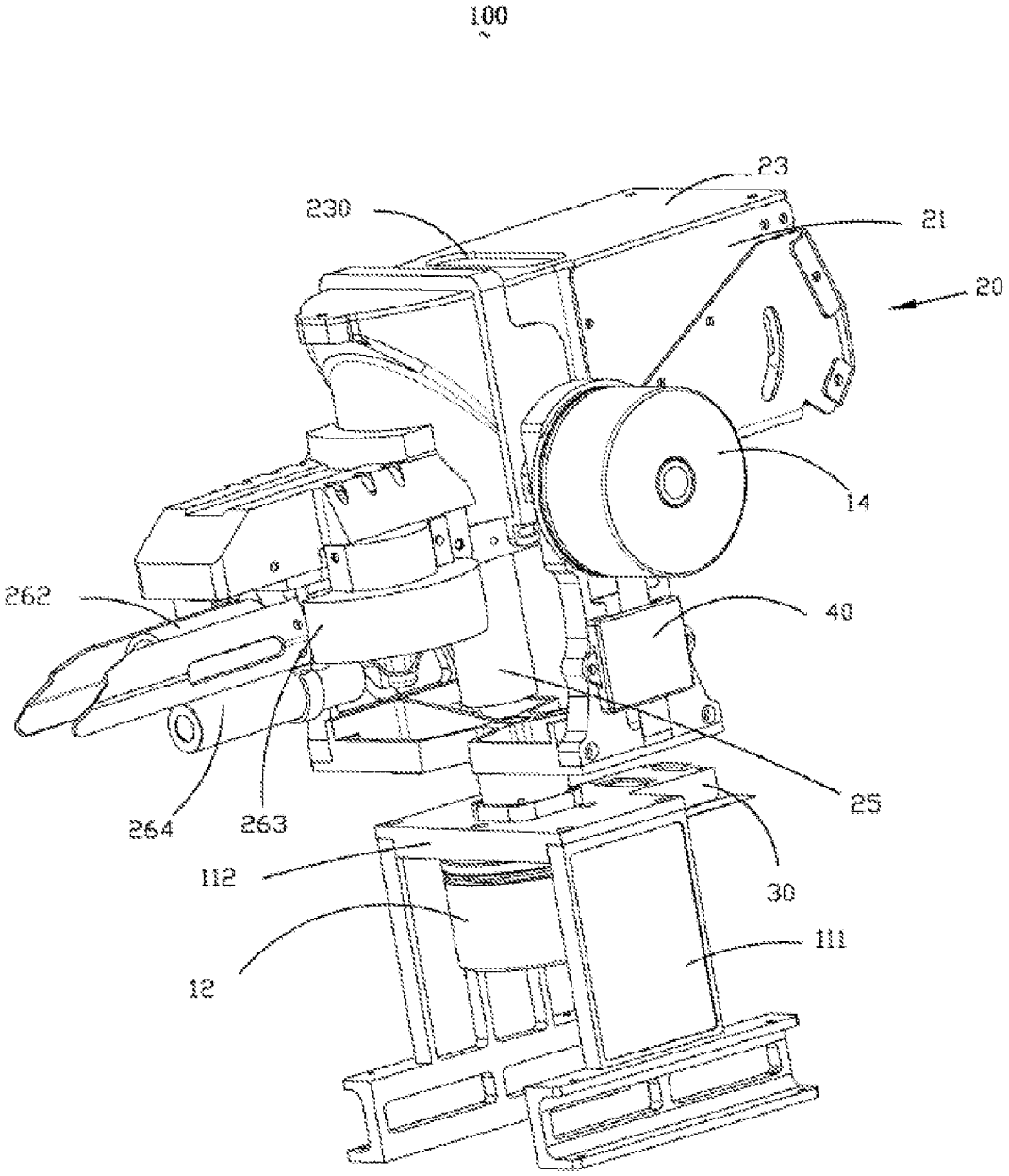
FIG. 1 is a schematic three-dimensional assembly diagram of a shooting game device according to the present disclosure.
Figure 2:
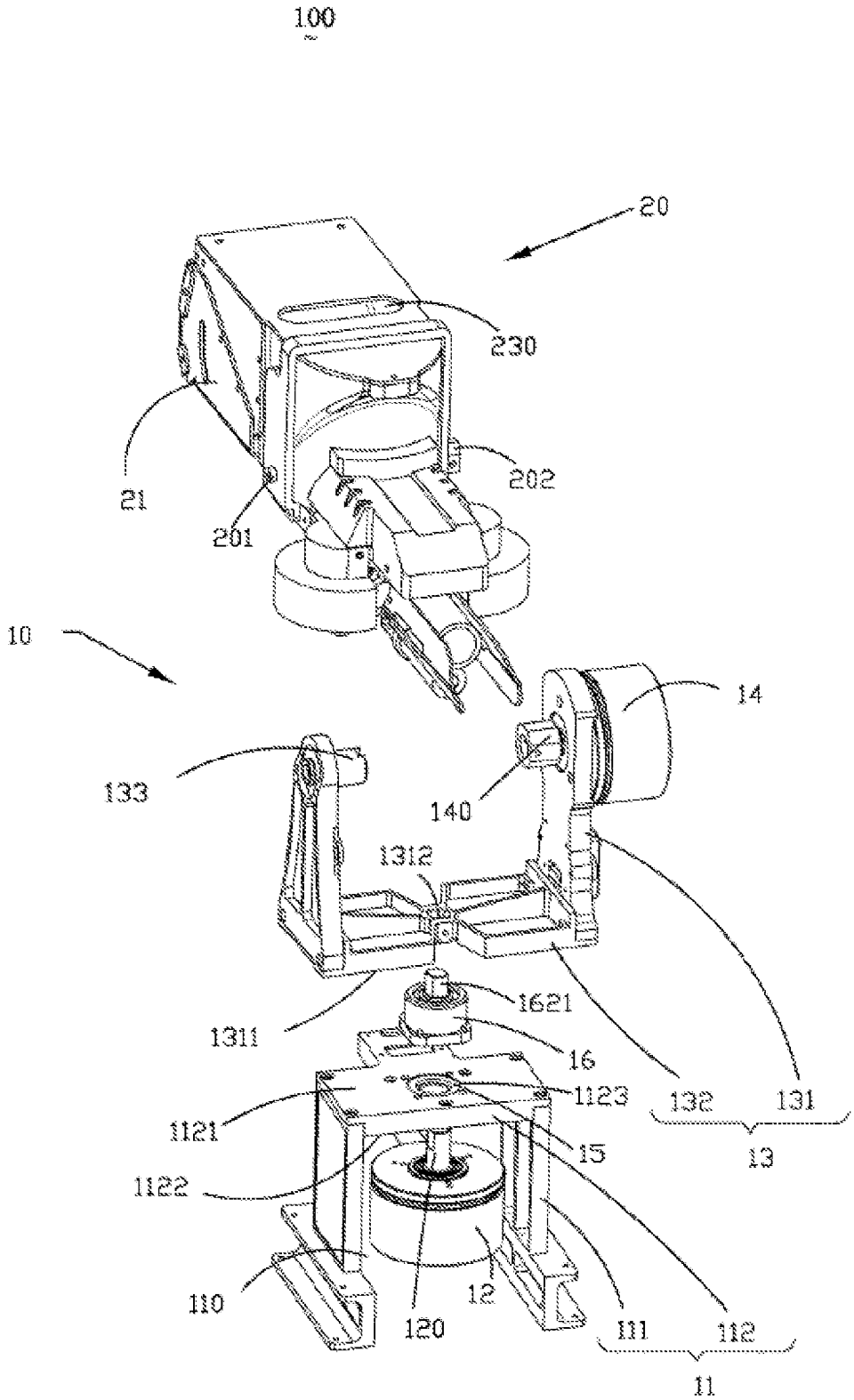
FIG. 2 is a schematic three-dimensional exploded diagram of the shooting game device in FIG. 1.

Referring to FIG. 1 to FIG. 2 together, a shooting game device 100 according to the present disclosure includes a position adjusting device 10 and a firing device 20 rotatably disposed on the position adjusting device 10.

The position adjusting device 10 includes a first support member 11, a yaw axis motor 12 disposed on the first support member 11, a second support member 13 rotatably disposed on the first support member 11 through the yaw axis motor 12, and a pitch axis motor 14 disposed on the second support member 13 and used for driving the firing device 20 to rotate.

The first support member 11 includes two first brackets 111 disposed substantially in parallel and a first connecting plate 112 that connects the two first brackets 111. The first connecting plate 112 is disposed substantially perpendicular to the first brackets 111. In this embodiment, the first connecting plate 112 is fixed onto the two first brackets 111 through bolted connection. The first connecting plate 112 includes a top surface 1121 and a bottom surface 1122 away from the top surface 1121. In this embodiment, the top surface 1121 is substantially parallel to the bottom surface 1122. The bottom surface 1122 and inner walls of the two first brackets 111 jointly form a receiving portion 110. The first connecting plate 112 is provided with a first through hole 1123 penetrating the top surface 1121 and the bottom surface 1122. The first through hole 1123 is in communication with the receiving portion 110.

It can be understood that the first connecting plate 112 and the two first brackets 111 may also be fixedly connected in other manner. For example, they are fixedly connected with each other by welding or glue, which is not limited to this embodiment.

The position adjusting device 10 further includes a bearing 15 and a mounting seat 16.

The bearing 15 is fixed into the first through hole 1123.

In this embodiment, the yaw axis motor 12 is a brushless motor, which includes a rotating shaft 120. The yaw axis motor 12 is received in the receiving portion 110 and fixed onto the bottom surface 1122, and the rotating shaft 120 passes through the bearing 15.

Figure 3:
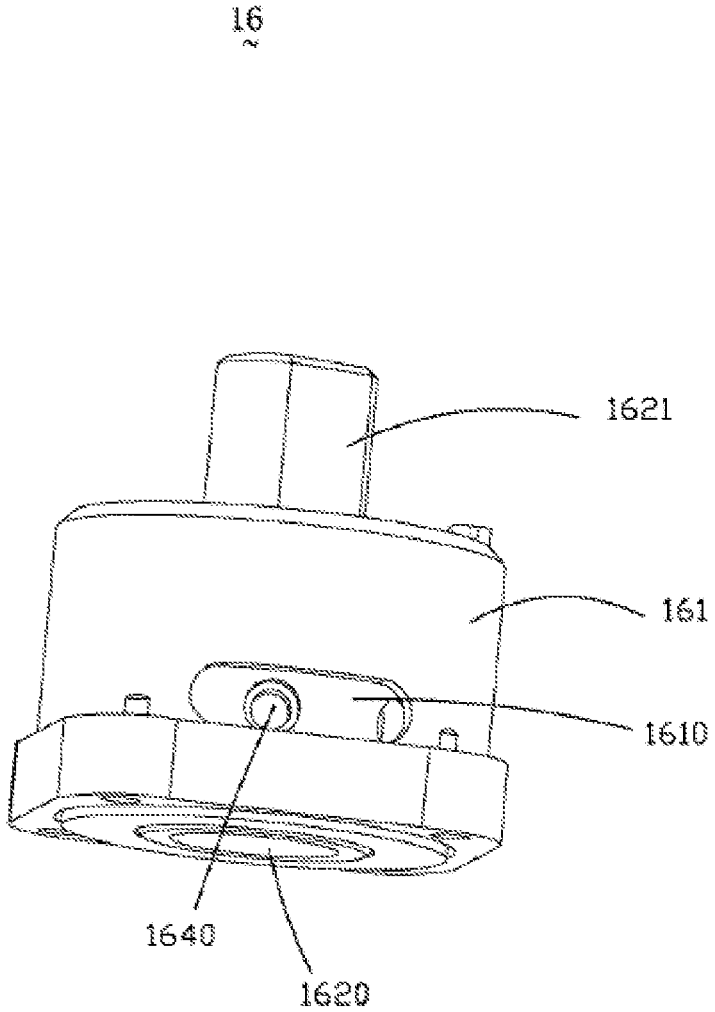
FIG. 3 is a schematic three-dimensional assembly diagram of the mounting seat in FIG. 2.
Figure 4:
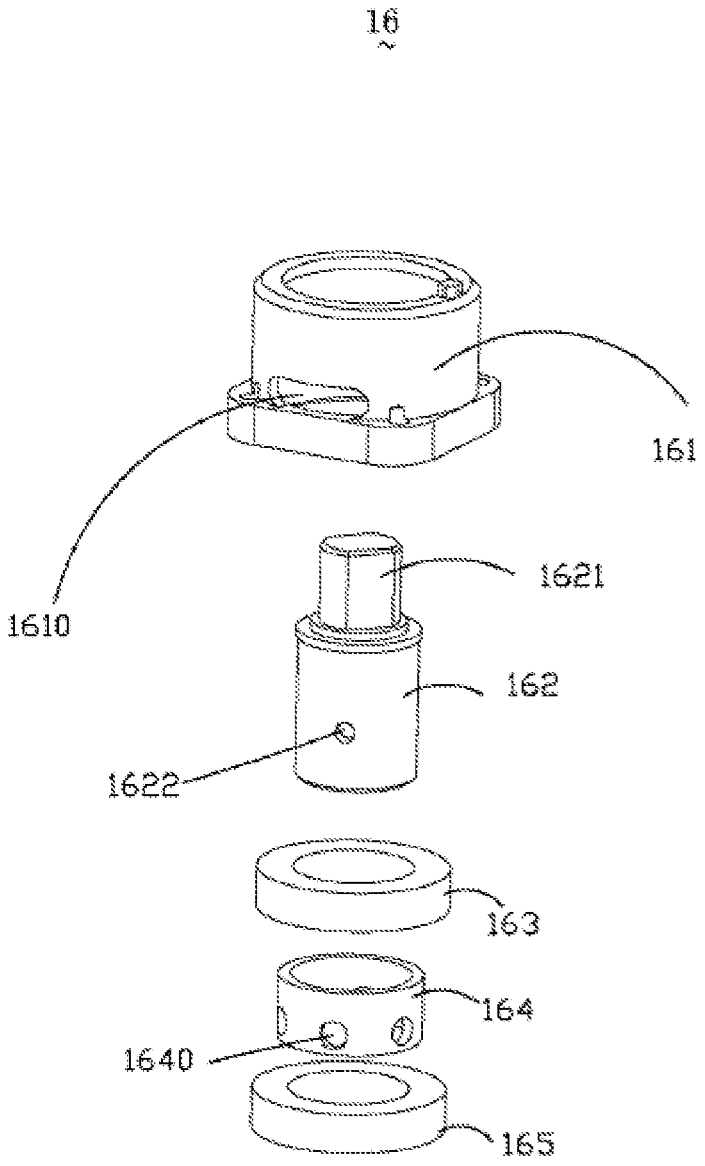
FIG. 4 is a schematic three-dimensional exploded diagram of the mounting seat in FIG. 3.

Referring to FIGS. 3-4 together, the mounting seat 16 is fixed onto the top surface 1121, and receives the rotating shaft 120. Specifically, the mounting seat 16 includes a receiving seat 161, a pivot shaft 162 disposed in the receiving seat 161, a first bearing 163, a fixing ring 164, and a second bearing 165. The receiving seat 161 is provided with a window 1610. In this embodiment, the pivot shaft 162 is hollow, which includes a receiving cavity 1620 for receiving the rotating shaft 120 of the yaw axis motor 12 and a connecting portion 1621. The pivot shaft 162 is provided with a first fixing hole 1622. The fixing ring 164 is provided with a plurality of second fixing holes 1640. The first bearing 163, the fixing ring 164, and the second bearing 165 are all sleeved on an outer sidewall of the pivot shaft 162. The fixing ring 164 is located between the first bearing 163 and the second bearing 165. At least one of the second fixing holes 1640 is aligned with the first fixing hole 1622.

During assembly, the rotating shaft 120 of the yaw axis motor 12 is inserted into the receiving cavity 1620, and the second fixing hole 1640 is exposed outside the receiving seat 161 through the window 1610. A fixing bolt (not shown) is inserted into the second fixing hole 1640 and the first fixing hole 1622 through the window 1610 to cause one end of the fixing bolt to abut against the rotating shaft 120, and in this way, the rotating shaft 120 is fixedly connected with the pivot shaft 162.

In this embodiment, the fixing bolt is a threaded bolt, and the first fixing hole 1622 and the second fixing holes 1640 are all threaded holes corresponding to the fixing bolt. It can be understood that it is also feasible to fixedly connect the rotating shaft 120 with the pivot shaft 162 in another manner. For example, they are fixedly connected with each other by welding or glue, which is not limited to this embodiment. To omit the machining process for the window 1610, the first fixing hole 1622, and the second fixing holes 1640, in other embodiments, it is also feasible to fixedly connect the rotating shaft 120 with the receiving cavity 1620 through interference fit, which is not limited to this embodiment.

The second support member 13 is rotatably mounted to the top surface 1121 of the first connecting plate 112 through the mounting seat 16. The second support member 13 includes two second brackets 131 disposed substantially in parallel and a second connecting plate 132 that connects the two second brackets 131. The second connecting plate 132 is disposed substantially perpendicular to the second brackets 131. In this embodiment, the second connecting plate 132 is fixed onto the two second brackets 131 through bolted connection. The second connecting plate 132 is disposed oppositely to the first connecting plate 112, and the second connecting plate 132 includes a lower end face 1311 disposed oppositely to the top surface 1121 of the first connecting plate 112. The second connecting plate 132 is provided with a receiving hole 1312, and the connecting portion 1621 of the pivot shaft 162 is fixed into the receiving hole 1312 to cause the second support member 13 to be carried over the top surface 1121 through the mounting seat 16.

In this embodiment, with the configuration of the mounting seat 16, it is possible to avoid the weights of the second support member 13, the pitch axis motor 14, and the firing device 20 from directly acting on the rotating shaft 120 of the yaw axis motor 12 to protect the yaw axis motor 12. It can be understood that, in other embodiments, when the rotating shaft 120 of the yaw axis motor 12 can carry a load with enough weight, it is also feasible that the mounting seat 16 is not provided, and the rotating shaft 120 of the yaw axis motor 12 is directly received in the receiving hole 1312, which is not limited to this embodiment.

The pitch axis motor 14 is disposed on one end of one of the second brackets 131 away from the second connecting plate 132. The pitch axis motor 14 includes a rotary shaft 140. One end of the other one of the second brackets 131 is provided with a fixed shaft 133.

Figure 5:
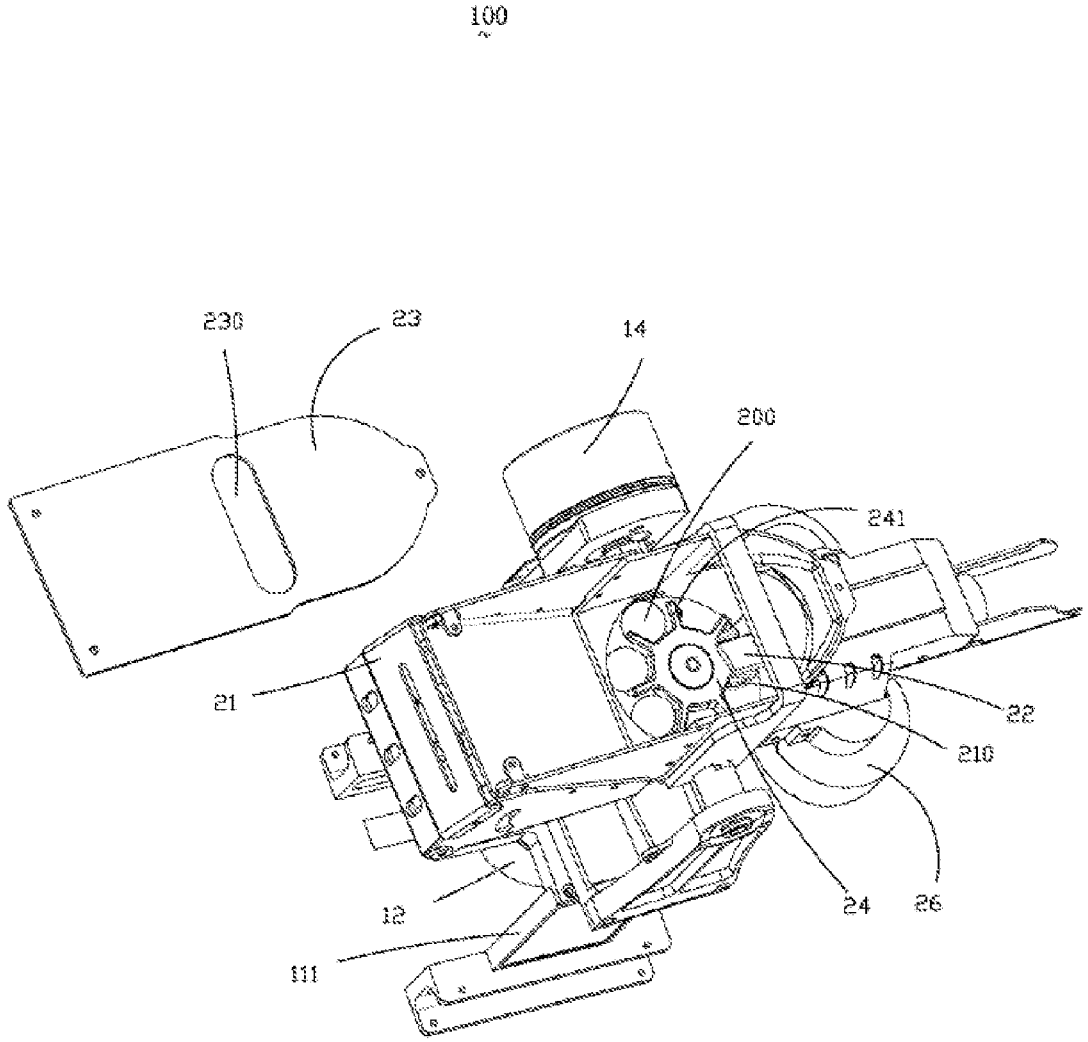
FIG. 5 is a schematic three-dimensional exploded diagram of another perspective of the shooting game device in FIG. 1.
Figure 6:
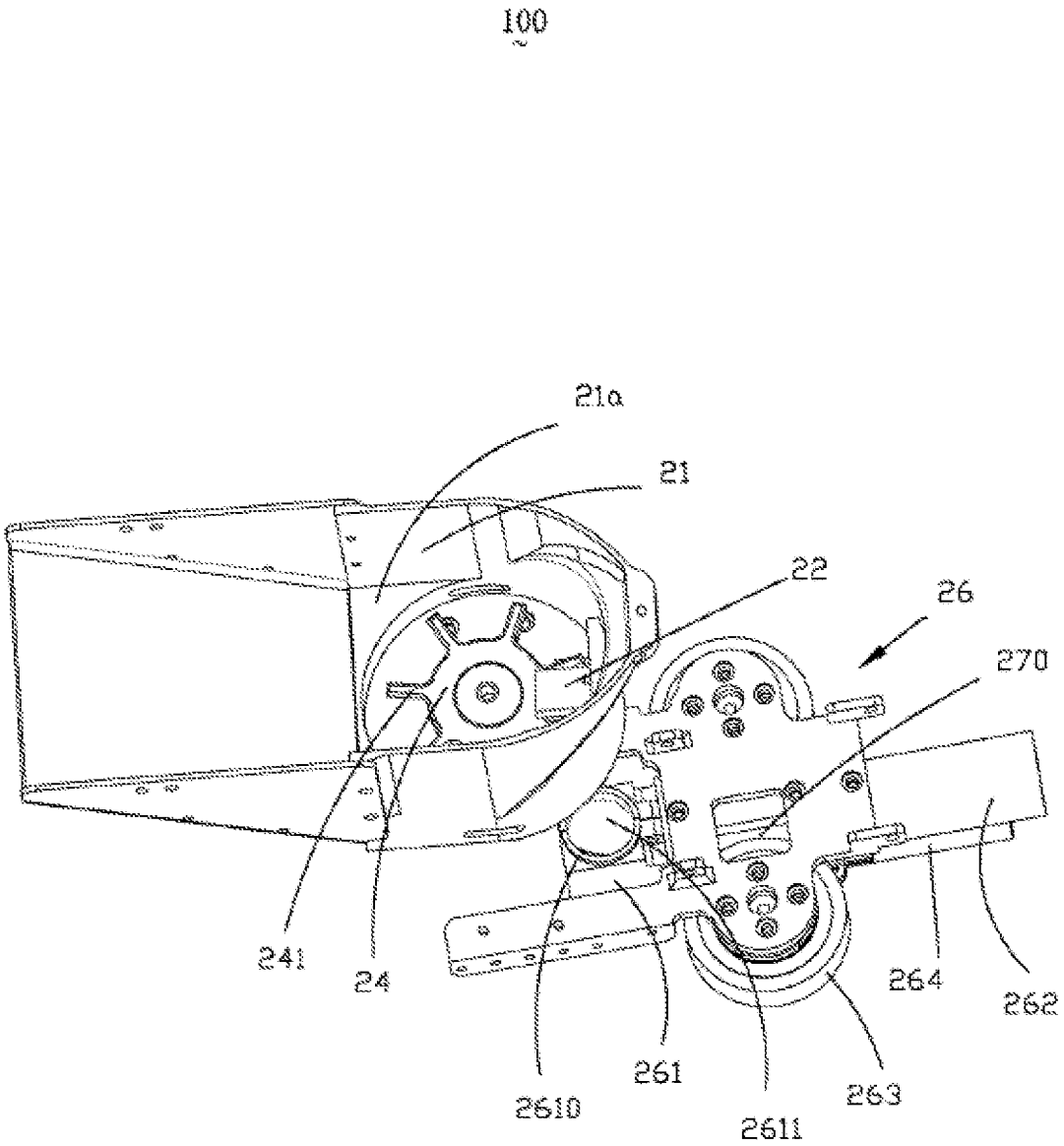
FIG. 6 is a schematic three-dimensional exploded diagram of another perspective of the shooting game device in FIG. 1.

Referring to FIG. 2 and FIGS. 5-6 together, the firing device 20 includes a magazine 21, a guide plate 22 disposed in the magazine 21, a cover plate 23 covering the magazine 21, a rotor 24 disposed in the magazine 21, a driving device 25 for driving the rotor 24 to rotate, and a turret 26 connected with the magazine 21.

The magazine 21 is used for receiving a plurality of toy bullets 200. In this embodiment, the magazine 21 has a bullet storage capacity of about 100 bullets. A bottom plate 21*a* of the magazine 21 is provided thereon with a bullet output port 210. In this embodiment, the bullet output port 210 is round. In can be understood that the bullet output port 210 may also be in another shape, which is not limited to this embodiment. One side wall of the magazine 21 is provided with a rotary pillar 201 corresponding to the position of the fixed shaft 33. Another side wall of the magazine 21 is provided with a hollow connecting pillar 202 corresponding to the position of the rotary shaft 140 of the pitch axis motor 14. During assembly, the rotary pillar 201 is sleeved in the fixed shaft 33, and the connecting pillar 202 is fixedly connected with the rotary shaft 140 through a bolt. It can be understood that, in an actual application, it is also feasible to fixedly connect them by welding or glue.

The guide plate 22 is arc-shaped, which is disposed above the bullet output port 210, and the guide plate 22 and the bottom plate 21*a* are at a certain bevel angle. In this way, the toy bullets 200 can smoothly enter into the bullet output port 210 along the slope of the bottom plate 21*a*.

The cover plate 23 is fixed to the magazine 21 through a bolt. It can be understood that the cover plate 23 may also be fixed to the magazine 21 in other fixing manners, which is not limited to this embodiment. The cover plate 23 is provided with an inlet 230, through which the toy bullets 200 can be put in.

It can be understood that, in order to save materials, in other implementation manners, the cover plate 23 may also be omitted.

The rotor 24 includes a plurality of blades 241. Two adjacent blades 241 are spaced apart from each other. The distance between the two adjacent blades 241 is slightly less than the diameter of the bullet output port 210, and a toy bullet 200 is clamped between each two adjacent blades 241.

The driving device 25 is a low-speed high-torque motor, which is fixed to the bottom plate 21*a* and connected with the rotor 24, for driving the rotor 24 to rotate. The driving device 25 is driven by a pulse signal, and each time the driving device 25 is triggered, an angle by which the rotor 24 is driven to rotate is equal to an angle between the two adjacent blades 241.

Figure 7:
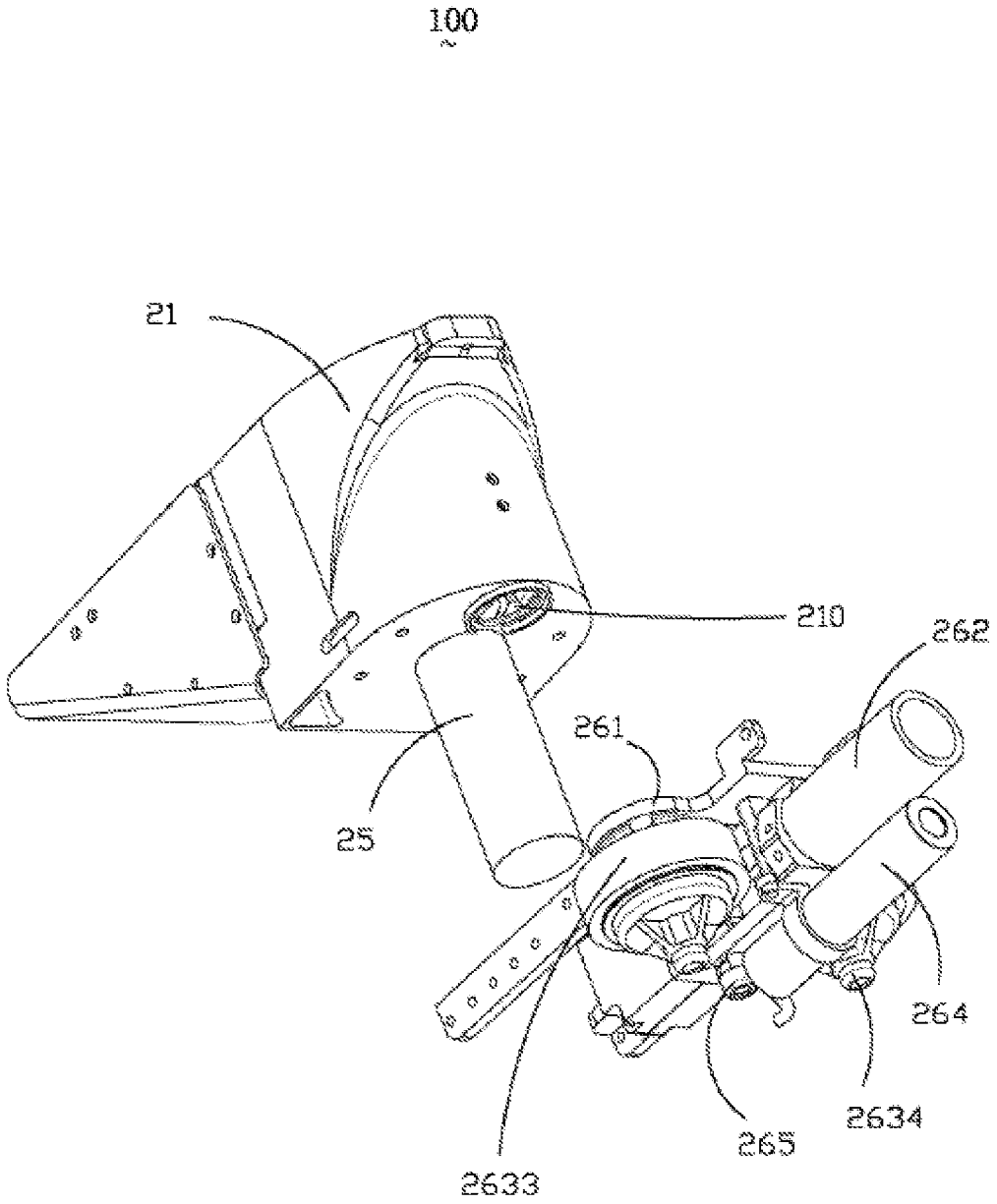
FIG. 7 is a schematic three-dimensional exploded diagram of another perspective of the shooting game device in FIG. 4.
Figure 8:
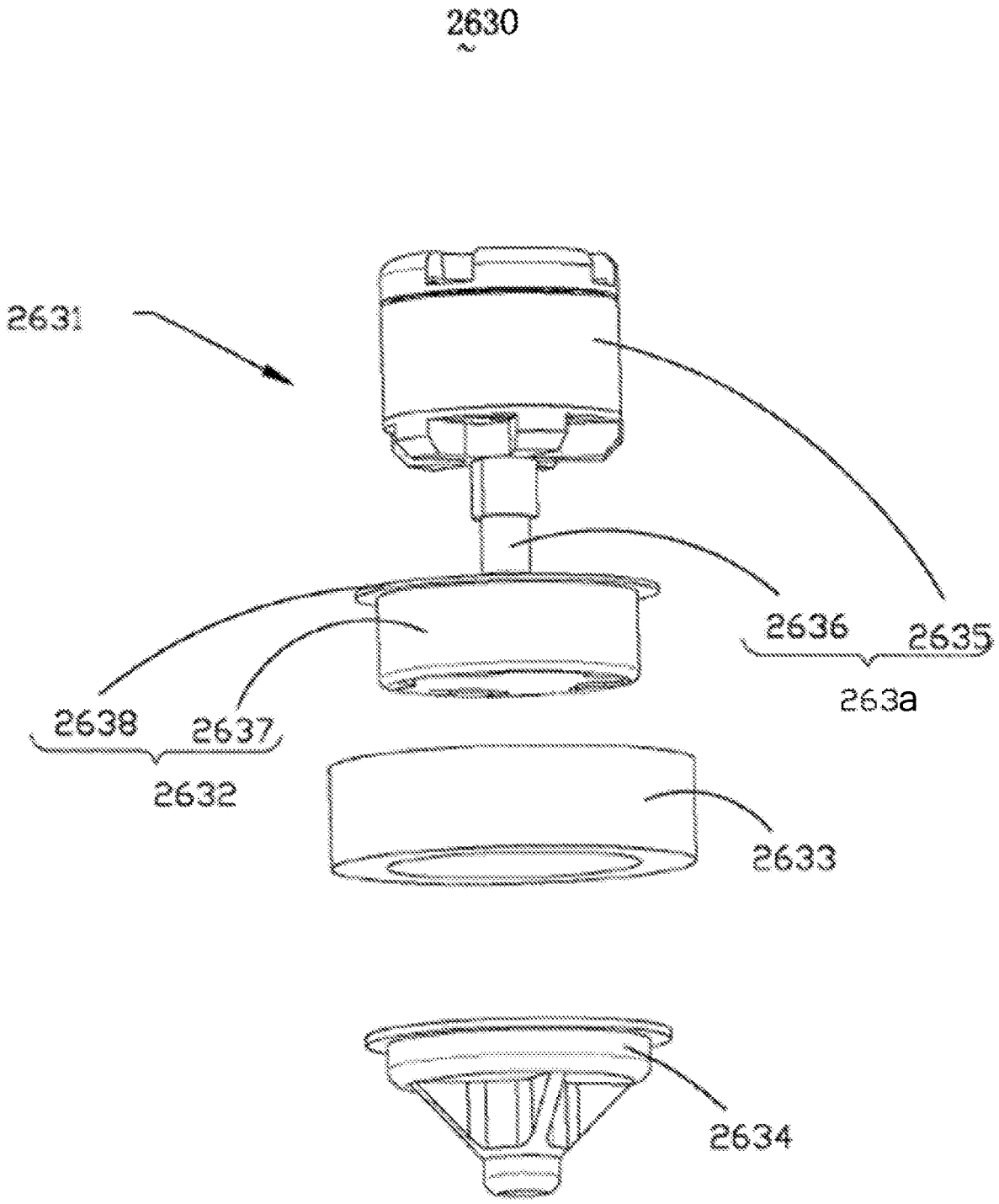
FIG. 8 is a schematic three-dimensional exploded diagram of the first driving device in FIG. 5.

Referring to FIGS. 7-8 together, the turret 26 is connected with the magazine 21. The turret 26 includes a conduit 261, a barrel 262 aligned with the conduit 261, a propelling device 263 disposed between the conduit 261 and the barrel 262, a sighting device 264 disposed below the barrel 262, and a limiting device 265 disposed between the conduit 261 and the barrel 262.

The conduit 261 is disposed below the magazine 21. The conduit 261 is provided with a guide slot 2610. In this embodiment, the guide slot 2610 is a 90-degree guide slot, which includes a round bullet inlet 2611 and a round bullet outlet. The bullet inlet 2611 is aligned with the bullet output port 210 of the magazine 21, and a central axis of the bullet inlet 2611 is substantially parallel to that of the bullet output port 210. A central axis of the bullet inlet 2611 is substantially parallel to that of the bullet outlet.

In this embodiment, the barrel 262 is a hollow tubular structure. The diameter of the barrel 262 is slightly greater than that of the toy bullet 200.

The propelling device 263 comprises two friction wheels 2630. The two friction wheels 2630 are disposed side by side between the guide slot 2610 and the barrel 262. A gap 270 formed between the two friction wheels 2630 is aligned with the bullet outlet of the guide slot 2610. Each of the friction wheels 2630 includes a motor 2631, a connecting ring 2632, an elastic ring 2633, and a protection ring 2634.

In this embodiment, the motor 2631 is a brushless motor, which includes a rotor portion 263*a*. The rotor portion 263*a* includes a first connecting portion 2635 connected with the connecting ring 2632 and a second connecting portion 2636 connected with the protection ring 2634.

The shape and size of the connecting ring 2632 match those of the first connecting portion 2635 respectively. The connecting ring 2632 is clamped onto the first connecting portion 2635 and rotates with rotation of the rotor portion 263*a*. The connecting ring 2632 includes a round body portion 2637 and a protrusion 2638 extending radially from the body portion 2637.

The elastic ring 2633 is hollow ring-like, which is made of a rubber material, is sleeved on the body portion 2637 of the connecting ring 2632, and abuts against the protrusion 2638.

In this embodiment, the protection ring 2634 is connected with the second connecting portion 2636 by threading and abuts against the elastic ring 2633.

In this embodiment, the two friction wheels 2630 rotate in opposite directions. The shortest spacing between the two elastic rings 2633 is slightly less than the diameter of the toy bullet 200, and when the friction wheels 2630 rotate in opposite directions, the two elastic rings 2633 exert friction on a toy bullet 200, causing the toy bullet 200 to gain a certain amount of kinetic energy such that the toy bullet 200 can be fired.

The sighting device 264 is a cross-shaped laser sight, which can facilitate the user to accurately shoot a target.

In this embodiment, the limiting device 265 is an elastic limiting device. A toy bullet 200 is pushed into the 90-degree guide slot 2610 by the blades 241. The toy bullets 200 are pushed into the guide slot 2610 one by one. With the setting of the limiting device 265, the toy bullet 200 closest to the barrel 262, after being pushed past the limiting position, arrives at the friction wheels 2630 rotating at a high speed, and then the toy bullet 200 is fired by being exerted with friction and squeezed. Setting the limiting device 265 can enhance shooting continuity.

In this embodiment, the connecting ring 2632 is provided with a protrusion 2638, which is aimed to prevent uneven assembly of the elastic ring 2633 to the body portion 2637.

It can be understood that, in an actual application, in order to save materials, it is also feasible to directly mount the elastic ring 2633 onto the first connecting portion 2635 of the rotor portion 263*a*, which is not limited to this embodiment.

It can be understood that, in other embodiments, it is also feasible that the protection ring 2634 is not provided.

It can be understood that, in other embodiments, the motor 2631 may also be another type of driving device, for example, a motor or the like, as long as it can drive the elastic ring 2633 to rotate, which is not limited to this embodiment.

It can be understood that, in other embodiments, it is also feasible that the limiting device 265 is not provided.

It can be understood that the structure of the position adjusting device 10 is not limited to this, and in an actual application, it is feasible as long as the firing device 20 can rotate about the yaw axis and the pitch axis.

It can be understood that, in other embodiments, the firing device 20 may also be another load, for example, a sprayer or the like.

Further referring to FIG. 1, in this embodiment, the shooting game device 100 further includes a first electronic speed control 30 and a second electronic speed control 40. The first electronic speed control 30 is disposed on the first connecting plate 112 and is electrically connected with the yaw axis motor 12, and the first electronic speed control 30 is used for adjusting a rotational speed of the yaw axis motor 12. The second electronic speed control 40 is disposed on one second bracket 131 of the second support member 13 and is electrically connected with the pitch axis motor 14, and the second electronic speed control 40 is used for adjusting a rotational speed of the pitch axis motor 14.

Figure 9:
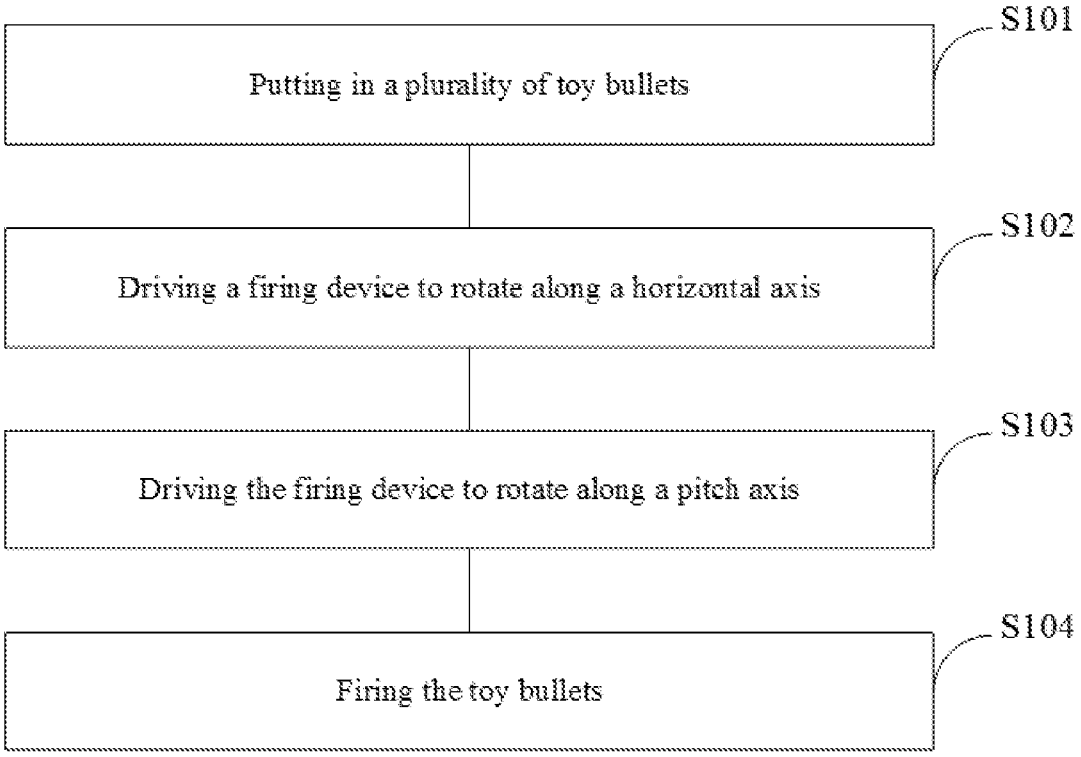
FIG. 9 is a flowchart of a shooting game method according to the present disclosure.

Referring to FIG. 9, a shooting method according to an embodiment of the present disclosure includes the following steps:

S101: A plurality of toy bullets 200 are put in;

In this embodiment, the operator may put in the plurality of toy bullets 200 through an inlet 230 of the cover plate 23.

A yaw axis motor 12 drives the firing device 20 to rotate about a yaw axis.

In this embodiment, the position adjusting device 10 includes a first support member 11, a yaw axis motor 12 disposed on the first support member 11, and a second support member 13 rotatably disposed on the first support member 11 through the yaw axis motor 12. The yaw axis motor 12 is used for driving the second support member 13 to rotate about a yaw axis to cause the firing device 20 to rotate about the yaw axis. Therefore, the firing device 20 can achieve an action of rotating horizontally flexibly and freely.

A pitch axis motor 14 drives the firing device 20 to rotate about a pitch axis. The pitch axis motor 14 is used for driving the firing device 20 to rotate about a pitch axis.

The position adjusting device 10 includes a pitch axis motor 14 disposed on the second support member 13 and used for driving the firing device 20 to rotate, and the firing device 20 can achieve an action of pitching up and down flexibly and freely.

S104: The toy bullets 200 are fired.

The magazine 21 has a capacity of about 100 bullets. The driving device 25 is used as a bullet feeding motor, which drives a rotor 24 having a plurality of blades 241 to rotate. A toy bullet 200 is held between two blades and driven to rotate with the rotor. When being rotated to the guide plate 22, the toy bullet 200 is pushed into the 90-degree guide slot 2610 by the blades. The toy bullets 200 are pushed to a position between the two friction wheels 2630 one by one The barrel 262 is provided with a limiting device. The foremost toy bullet 200, after being pushed past the limiting position, arrives at the friction wheels 2630 rotating at a high speed, and then the toy bullet 200 is fired by being exerted with friction and squeezed. The firing device 20 has a fast rate of fire and can fire 10 bullets per second on average. The firing device 20 can achieve single shot and continuous shot modes by controlling the driving device 25, and can also control the speed of the two friction wheels 2630, thus changing the rate of fire of the toy bullets 200. Such a principle scheme is simple and practical, which can ensure stability of the firing of the toy bullets 200 and can control well the rate of fire of the toy bullets 200.

It can be understood that the method of the present disclosure is not limited to any order of steps.

The position adjusting device according to the present disclosure can drive the firing device to rotate about a yaw axis through the yaw axis motor, and at the same time, can drive the firing device to rotate about a pitch axis through the pitch axis motor, so that the position adjusting device controls the firing device to achieve actions of rotating horizontally and pitching up and down flexibly and freely. This puts forward higher requirements for both the stability and the speed at which the actions are completed, and can also avoid manually adjusting the direction of the muzzle. The operation steps are simple and highly entertaining. In addition, owing to the absence of a reduction gearbox or another torque increasing mechanism, the problem that the mechanism is complicated is solved.

The above descriptions merely relate to exemplary embodiments of the present disclosure, but are not intended to limit the present disclosure. Any modification, equivalent replacement, improvement and the like made within the spirit and principle of the present disclosure should all be included in the scope of the present disclosure.

What is claimed is:

1. A position adjusting device comprising:

a first support member;

a mounting seat disposed on the first support member and including a receiving seat and a pivot shaft disposed at least partially within a space formed by the receiving seat; and a second support member carried by the receiving seat.

2. The position adjusting device of claim 1, further comprising:

a yaw axis motor disposed at the first support member, a rotating shaft of the yaw axis motor being connected to the pivot shaft of the mounting seat, and the yaw axis motor being configured to drive the pivot shaft of the mounting seat to rotate so as to drive the second support member to rotate.

3. The position adjusting device of claim 2, wherein:

the pivot shaft of the mounting seat includes a receiving cavity; and the rotating shaft of the yaw axis motor is received in the receiving cavity.

4. The position adjusting device of claim 2, wherein:

the first support member includes two brackets and a connecting plate connecting the two brackets, the two brackets and the connecting plate forming a receiving portion; and the yaw axis motor is received in the receiving portion and fixed on a bottom surface of the connecting plate.

5. The position adjusting device of claim 4, wherein:

the connecting plate includes a through hole penetrating through the connecting plate; and the rotating shaft of the yaw axis motor passes through the through hole to connect to the pivot shaft of the mounting seat.

6. The position adjusting device of claim 5, further comprising:

a bearing fixed in the through hole;

wherein the rotating shaft of the yaw axis motor passes through the bearing.

7. The position adjusting device of claim 4, wherein:

the two brackets are two first brackets and the connecting plate is a first connecting plate;

the second support member includes two second brackets and a second connecting plate connecting the two second brackets; and a direction of the two first brackets extending from the first connecting plate is opposite to a direction of the two second brackets extending from the second connecting plate.

8. The position adjusting device of claim 1, wherein:

the second support member includes a receiving hole; and the pivot shaft of the mounting seat includes a connecting portion fixed in the receiving hole.

9. The position adjusting device of claim 1, wherein the mounting seat further includes a fixing ring sleeved on an outer sidewall of the pivot shaft.

10. The position adjusting device of claim 9, wherein:

the mounting seat further includes a first bearing and a second bearing sleeved on the outer sidewall of the pivot shaft; and the fixing ring is located between the first bearing and the second bearing.

11. The position adjusting device of claim 1, further comprising:

a pitch axis motor disposed at the second support member and configured to drive a load carried by the second support member to rotate about a pitch axis.

12. A shooting game assembly comprising:

a firing device; and a position adjusting device carrying the firing device, the position adjusting device including:

a first support member;

a mounting seat disposed on the first support member and including a receiving seat and a pivot shaft disposed at least partially within a space formed by the receiving seat; and a second support member carried by the receiving seat and carrying the firing device.

13. The shooting game assembly of claim 12, wherein the firing device includes:

a magazine configured to receive a plurality of toy bullets; and a turret connected with the magazine and configured to receive one toy bullet of the plurality of toy bullets pushed from the magazine and to fire the one toy bullet.

14. The shooting game assembly of claim 13, wherein the turret includes:

a conduit disposed below the magazine and configured to receive the one toy bullet;

a propelling device configured to accelerate and fire the one toy bullet; and a limiting device disposed between the conduit and the propelling device.

15. The shooting game assembly of claim 14, wherein the limiting device includes an elastic limiting device.

16. The shooting game assembly of claim 14, wherein:

the turret further includes a barrel aligned with the conduit; and the limiting device and the propelling device are disposed between the conduit and the barrel.

17. The shooting game assembly of claim 14, wherein:

a bottom plate of the magazine includes a bullet output port; and the conduit includes a guide slot including a bullet inlet approximately aligned with the bullet output port of the magazine.

18. The shooting game assembly of claim 13, wherein the firing device further includes:

a rotor disposed in the magazine and including a plurality of blades configured to clamp the toy bullets; and a driving device fixed onto a bottom plate of the magazine and connected with the rotor, the driving device being configured to drive the rotor to rotate.

19. The shooting game assembly of claim 12, wherein the position adjusting device further includes a yaw axis motor disposed at the first support member, a rotating shaft of the yaw axis motor being connected to the pivot shaft of the mounting seat, and the yaw axis motor being configured to drive the pivot shaft of the mounting seat to rotate so as to drive the second support member to rotate.

20. The shooting game assembly of claim 12, wherein the position adjusting device further includes a pitch axis motor disposed at the second support member and configured to drive the firing device to rotate about a pitch axis.

* * * * *